US006286951B1

(12) United States Patent
Drake

(10) Patent No.: US 6,286,951 B1
(45) Date of Patent: Sep. 11, 2001

(54) METHOD FOR FORMING AN INK JET PRINTHEAD WITH INTEGRAL INK FILTER

(75) Inventor: Donald John Drake, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/699,514

(22) Filed: Oct. 31, 2000

Related U.S. Application Data

(62) Division of application No. 09/325,157, filed on Jun. 3, 1999, now Pat. No. 6,234,623.

(51) Int. Cl.[7] ..... B41J 2/175
(52) U.S. Cl. ..... 347/93
(58) Field of Search ..... 347/85, 86, 87, 347/93, 65, 71, 63

(56) References Cited

U.S. PATENT DOCUMENTS

| | | | | |
|---|---|---|---|---|
| 4,639,748 | | 1/1987 | Drake et al. . | |
| 4,774,530 | | 9/1988 | Hawkins . | |
| 4,835,553 | * | 5/1989 | Torpey et al. | 347/65 |
| 5,124,717 | | 6/1992 | Campanelli et al. . | |
| 5,141,596 | | 8/1992 | Hawkins et al. . | |
| 5,204,690 | | 4/1993 | Lorenze, Jr. et al. . | |
| 5,489,930 | | 2/1996 | Anderson . | |
| 6,234,623 | * | 5/2001 | Drake | 347/93 |

* cited by examiner

*Primary Examiner*—N. Le
*Assistant Examiner*—Michael Nghiem
(74) *Attorney, Agent, or Firm*—Oliff & Berridge, PLC

(57) ABSTRACT

A method of forming an ink jet printhead with an integral ink filter is provided. The ink jet printhead has decreased flow resistance by formation of two filter array portions. A set of parallel openings are anisotropically etched in a surface of a first substrate to form a first filter array portion. A second substrate having an insulating layer therein is patterned to expose a set of openings forming a second filter array portion. The first and second portions are between an integral ink chamber and ink nozzles so that ink can be filtered through at least one of the first and second filter array portions.

10 Claims, 8 Drawing Sheets

METHOD FOR FORMING AN INK JET PRINTHEAD WITH INTEGRAL INK FILTER

This is a Division of application Ser. No. 09/325,157 filed Jun. 3, 1999 now U.S. Pat. No. 6,234,623. The entire disclosure of the prior application(s) is hereby incorporated by reference herein in its entirety.

BACKGROUND OF THE INVENTION

1. Field of Invention

This invention relates to an improved integral ink filter for an ink jet printhead that has decreased flow resistance and minimal machine cost to implement. The integral ink filter includes both a first filter portion patterned in a silicon channel plate of the printhead and a second filter portion patterned in a polyimide layer located between the channel plate and a heater plate.

2. Description of Related Art

Integral ink filters for ink jet printheads are known. Examples of such are U.S. Pat. No. 4,639,748 to Drake et al., U.S. Pat. No. 5,124,717 to Campanelli et al., U.S. Pat. No. 5,141,596 to Hawkins et al., and U.S. Pat. No. 5,204,690 to Lorenze, Jr. et al.

Of these, only U.S. Pat. No. 4,639,748 includes an integral, internal ink filter positioned within the channel plate before the individual ink channel nozzles. However, while its ink filter fabrication costs are small, it suffers an undesirable problem in that the filter pore open area is on the same order as the channel array density. Accordingly, such an ink filter induces significant ink flow resistance, which is detrimental to ink refill frequency.

The other cited references include a membrane filter fabricated over an ink fill opening between an ink supply cartridge and the ink manifold of the printhead (i.e., external to the channel plate and affixed to an outer face thereof). As such, these latter patents require additional fabrication costs and time to pattern and implement the ink filter assembly. Further, such a filter is quite removed from the nozzles.

Another known ink filter is the integral filter provided on the Hewlett Packard HP722 color printhead.

As technology moves towards smaller drop capability and thus increased resolution, there is a need for a better integral ink filter that can be fabricated with only minimal impact on manufacturing costs, while achieving a desired small pore size and decreased flow resistance.

SUMMARY OF THE INVENTION

In ink jet printers, very small nozzles having correspondingly small flow areas are required to produce small ink droplets for printing. Current ink jet trends are requiring smaller and smaller ink droplets. This necessitates the use of a very fine filtration system to prevent contaminating particles from clogging the small printhead nozzles. To maximize effectiveness, the filtration system should be located close to the nozzles so as to not restrict ink flow. However, as pore sizes decrease, flow rates of ink to the nozzles accordingly decrease.

The present invention overcomes the above problems by providing an integral ink filter having two separate filter portions fabricated on separate elements of an ink jet printhead. In particular, the invention in exemplary embodiments provides a first filter array portion formed in a channel plate of the printhead and a second filter array portion patterned and formed in an insulating layer sandwiched between the channel plate and a heater plate of the printhead. The filter arrays have a pore size equal to or smaller than the width of the individual ink channels.

Applicants have found that the additional filtering, in addition to the filtering achieved by an internal filter as used in U.S. Pat. No. 4,639,748, can be achieved by creating filtration pores in the already existing thick film structure interposed between the channel plate and the heater plate. Moreover, as this thick film structure already requires photolithographic patterning, such as to remove portions over heating elements and between the ink manifold and the nozzle channels, there is no additional processing steps necessary. As such, the present invention achieves improved filtration, while retaining a small pore size corresponding to a channel size of the nozzles, by doubling the filtration rate and maintaining a desired ink flow to the nozzles.

In a first exemplary embodiment of the invention, a plurality of ink jet printheads with integral, internal ink filters are fabricated from two separate substrates, such as silicon (100) wafers. The printheads are preferably of the thermal, drop-on-demand type and adapted for carriage printing. However, the invention is applicable to other ink jet printheads.

A plurality of sets of heating elements and their individual addressing electrodes are formed on a surface of one of the wafers (i.e., heater wafer) and a corresponding plurality of sets of parallel channels are etched in a surface of the other wafer (i.e., channel wafer) , with each channel communicating with a recessed manifold through a first integral filter array formed in the channel wafer between the manifold and channels. A fill hole and alignment openings are etched in the other surface of the channel wafer. The heating elements and channels are aligned and bonded together with a thick film organic structure, such as polyimide, interposed therebetween. Prior to bonding, the thick film organic structure is patterned and etched to form a second filter array. A plurality of individual printheads are obtained by dicing the two bonded wafers.

Each printhead is fixedly positioned on a daughterboard with the manifold fill hole exposed so that the channel nozzles are parallel to the daughterboard edge. The printhead and daughterboard are mounted on an ink supply cartridge so that the printhead fill hole is coincident with an aperture in the cartridge to fill and maintain ink in the printhead manifold and associated ink channels.

The printhead and cartridge may be mounted on a carriage of an ink jet printer adapted for reciprocation across the surface of a recording medium, such as paper. Current pulses are selectively applied to the heating elements in each channel from a controller in the printer in response to receipt of data signals by a controller in a known fashion. In a pagewidth configuration, the printhead array can be fixed and oriented perpendicular to a direction of movement of the recording medium. During the printing operation, the recording medium continually moves at a constant velocity in a known fashion.

The current pulses cause the heating elements to transfer thermal energy to the ink, vaporizing the ink as known in the art to produce a bubble. The heating element cools after the passage of the current and the bubble collapses. This bubble formation forms an ink droplet and propels it towards the recording medium.

DETAILED DESCRIPTION OF PREFERRED EMBODIMENTS

Figure 1:
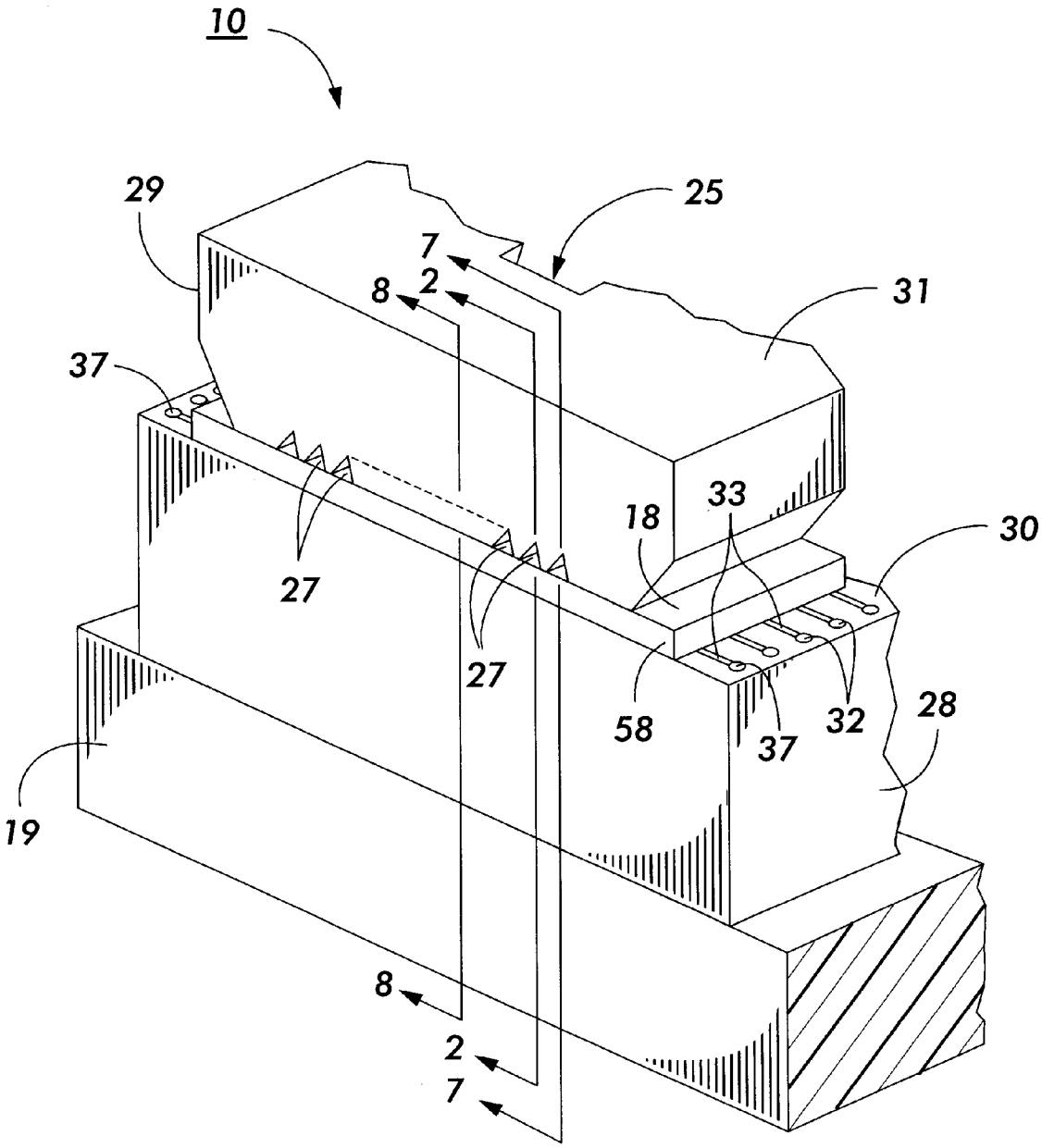
FIG. 1 is a partial isometric view of a printhead and daughterboard according to the invention.
Figure 2:
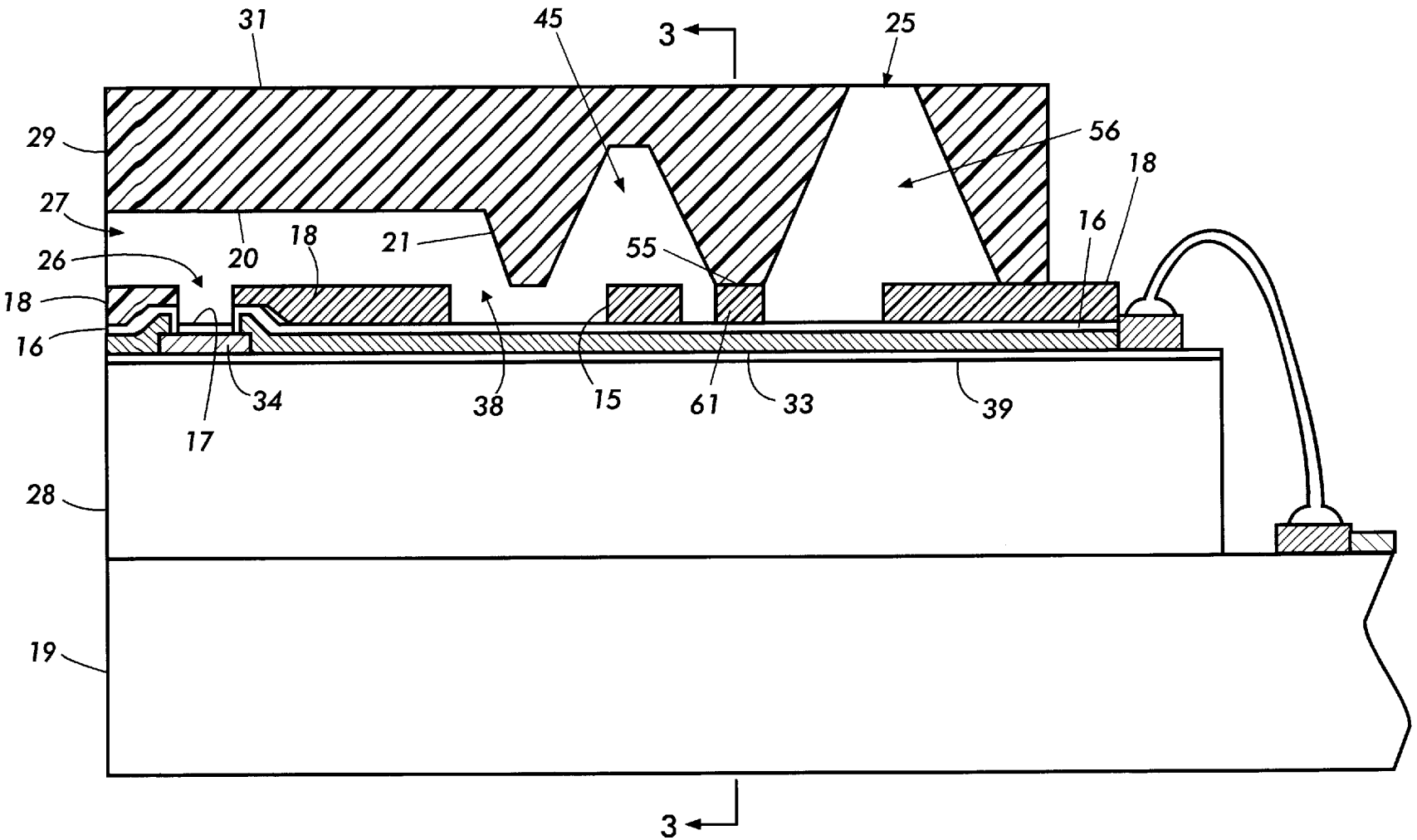
FIG. 2 is an enlarged cross-sectional view of FIG. 1 as viewed along line 2—2 showing electrode passivation, an ink flow path between the manifold and ink channels, and internal filter structure according to an embodiment of the invention.

Referring to FIGS. 1–2, a first exemplary embodiment is illustrated in which a front face of a printhead 10 includes an array of droplet emitting nozzles 27. A heater plate 28, preferably formed from silicon, has an electrically insulating surface 30 on which heating elements 34, addressing electrodes 33 and terminals 37, 32 are patterned on, while channel plate 31, also preferably formed from silicon, has parallel grooves 20 that extend in one direction and penetrate through the channel plate front face 29. The other end of grooves 20 terminate in slanted wall 21. The grooves 20 form ink channels 27. An ink supply manifold 45 is adjacent the channels 27. An internal chamber 56 is adjacent ink supply manifold 45 and receives ink therein through a fill hole 25, which is connected to a source of ink such as an ink cartridge. The terminals 32 are exposed and available for wire bonding to daughterboard 19, on which printhead 10 is mounted.

The channel plate 31 also includes etched openings 55 forming an ink filter array in the channel plate. The openings 55 preferably extend at least in one row parallel to front face 29 between internal chamber 56 and supply manifold 45 to filter ink as it passes from the internal chamber 56 to supply manifold 45. However, multiple row arrays or offset arrays can be used.

Channel plate 31 can be formed by providing a masking layer, such as a pyrolytic CVD silicon nitride layer, deposited on one or both sides of the channel plate 31. Preferably, channel plate 31 can be formed by using a single masking layer of a first side of the wafer. This side is then photolithographically patterned to form vias in the silicon nitride layer for subsequent anisotropic etching of the ink manifold 45, internal chamber 56, channels 27, and openings 55. By allowing the etch to continue through the entire thickness of the channel plate 31 in the area of the internal chamber 56, fill hole 25 can be formed by the etched through hole.

Thus far, the formation of and description of the channel plate 31 is consistent with and similar to the methods of U.S. Pat. No. 4,639,748, assigned to the same assignee as the present invention and incorporated herein by reference in its entirety.

Heater plate 28 is formed with an underglaze layer 39. The electrodes 33 and heating elements 34 are formed over the underglaze layer 39. A passivation layer 16 is then formed over the underglaze layer 39, electrodes 33 and heating elements 34. A protective layer 17 is provided over heating elements 34. A thick film type insulative layer 18 is then formed on passivation layer 16. Layer 18 can be formed, for example, from Riston®, Vacrel®, Probimer 52®, or more preferably polyimide. Thick film insulating layer 18 is photolithographically patterned and etched to remove selected areas 26 over the heating elements 34 to expose the heating elements 34, and at areas 38 to provide an ink flow path from ink supply manifold 45 to ink channels 27. Thus far, the formation of the heater plate 31 is conventional, such as that described in U.S. Pat. No. 4,774,530 to Hawkins, assigned to the same assignee as the present invention and incorporated herein by reference in its entirety. However, the invention is not limited to such heater plate structure and is adaptable to other heater plate configurations.

The invention differs from typical heater plates, such as that disclosed in either U.S. Pat. Nos. 4,774,530 or 4,639,748, in that typical heater plates do not include any internal filter structure. However, Applicant has found that filtration effectiveness can be greatly increased by providing a second filter array portion in addition to a filter array provided in the channel plate 31. This second filter array can be added with minimal cost and no additional processing by adding a second filter array structure in the insulating layer 18, which is formed between channel plate 31 and heater plate 28.

To achieve this second filter array, the insulating layer 18 is deposited on the upper surface of heater plate 28 to a suitable thickness of between 5–100 micrometers. In addition to the structures conventionally formed in the insulating layer, such as areas 26 and 38, insulating layer 18 is further provided with a series of apertures 60 defined by columns 61. The apertures 60 can be formed by a photolithographic pattern and subsequently etched during formation of the areas 26 and 38. As insulating layer 18 already requires photolithography and etching steps to form areas 26 and 38, the additional filter array can be formed without increasing processing steps or machine cost.

Apertures 60 and columns 61 are preferably aligned in a linear row that extends parallel to the front face 29 and most preferably opposed to etched openings 55 provided on the channel plate 31. When opposed to etched openings 55, the apertures 60 are offset laterally from the openings 55 (columns 61 directly oppose etched openings 55) so that they form first and second filter array portions of a particular pore size to filter out particulates or contaminants that may agglomerate in the internal chamber prior to the contaminants reaching the ink nozzles 27. See FIG. 3.

It is preferable for both filter arrays to have substantially the same pore size. By making the pore size small, a fine filter structure can be provided that removes even the smallest of contaminants, with the two filter portions doubling the effective filter area of the filter without increasing pore size. This increases the flow of ink through the filter. The particular pore size chosen will depend on the size/width of the ink channels forming ink nozzles of the printhead. The pore size of the filter arrays should be selected to be equal to or smaller than the size/width of the ink channels so that contaminants will not pass through the filter and clog the individual ink channels.

Figure 3:
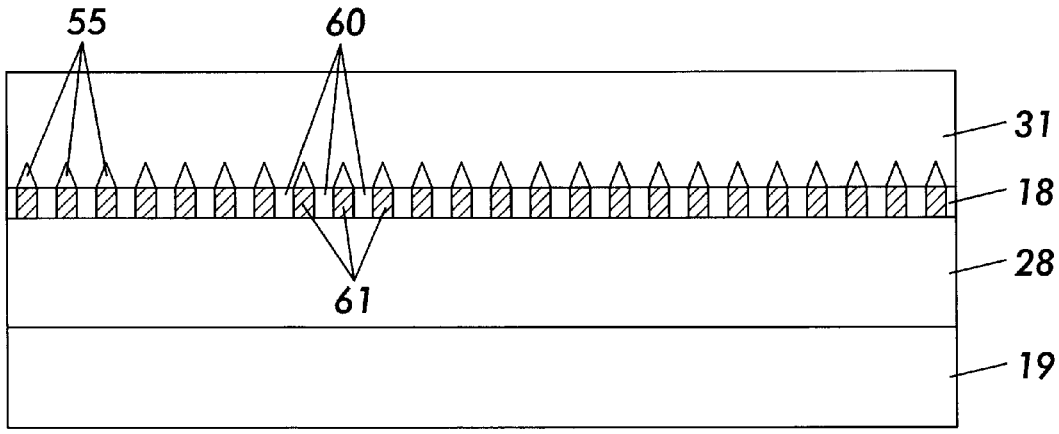
FIG. 3 is an enlarged cross-sectional view of FIG. 2 taken along line 3—3 showing the two part internal filter structure according to the invention.
Figure 4:
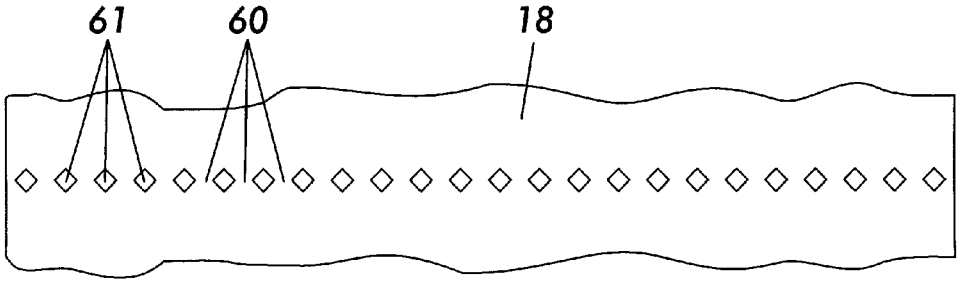
FIG. 4 is a partial top view of a patterned and formed insulating layer having columns and openings forming a second filter array portion of the printhead according to an embodiment of the invention.

The fully fabricated heater plate 28 with insulating layer 18 is aligned and bonded to channel plate 31 to form printhead 10 as shown in FIGS. 1–3.

Figure 5A:
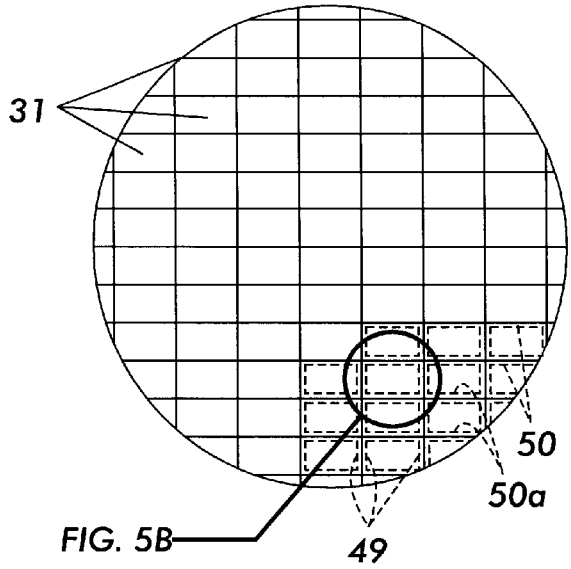
FIG. 5 is a schematic plan view of a wafer having a plurality of ink manifold recesses, each manifold having an array of channels and a filtration wall in the manifold concurrently etched therein, one enlarged manifold recess with its filtration wall and associated array of channels being shown, as well as one enlarged alignment opening.
Figure 5B:
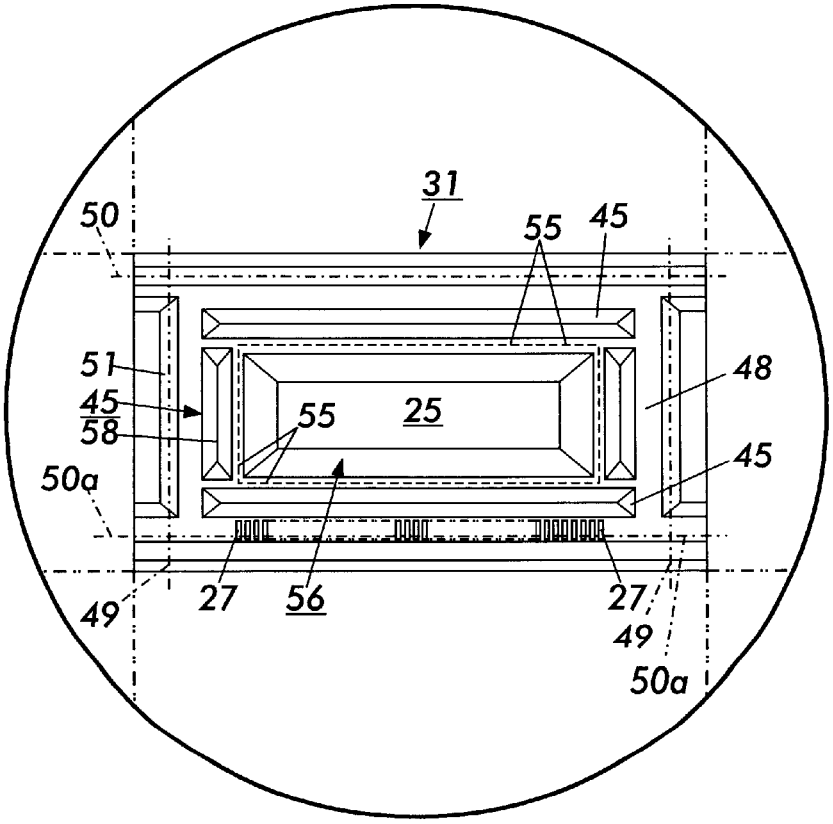

FIG. 5 illustrates a silicon wafer substrate on which a plurality of channel plates 31 are formed and subsequently separated by dice cuts 49,50. An enlarged top view of channel plate 31 is also illustrated and shows the linear array of nozzles 27 adjacent ink manifold 45 and etched openings 55 forming the first filter array portion between ink manifold 45 and ink chamber 56.

Figure 6:
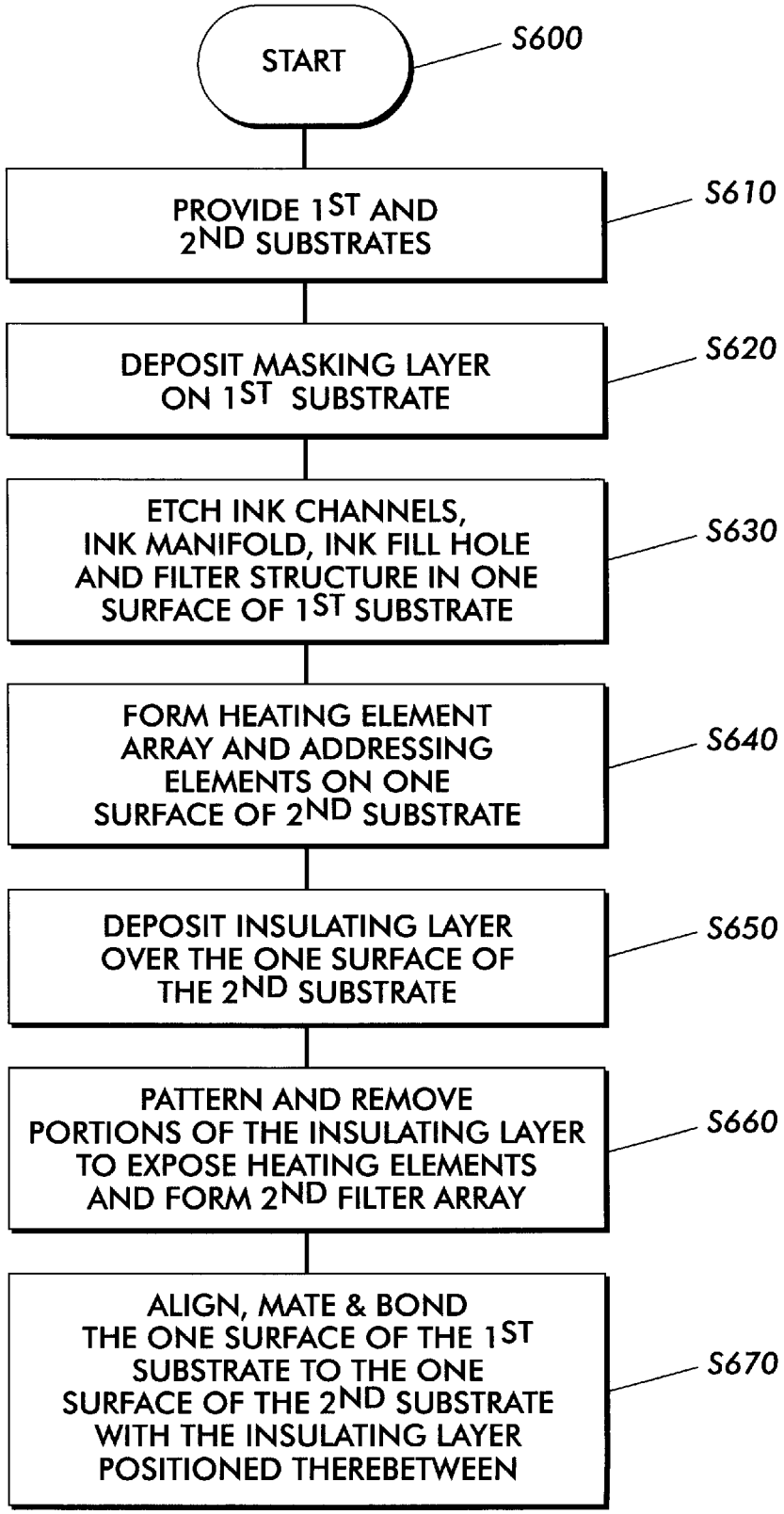
FIG. 6 is a flow chart of an exemplary manufacturing process for forming an ink jet printhead according to the invention.

The inventive ink jet printhead with integral filter arrays can be formed according to the exemplary manufacturing process set forth in the flow chart of FIG. 6. In particular, the manufacturing process starts at Step S600 and proceeds to step S610 where first and second substrates, such as silicon (100) wafers, are provided. Then, at step S620, a masking layer, such as a pyrolytic CVD silicon nitride is deposited on one surface of the first substrate, which will eventually form channel plate 31. Then, the first substrate is suitably photolithographic patterning on the one surface of the first substrate and ink channels 27, ink manifold 45 and ink internal chamber 56 are etched at step S630. This etching can be achieved by an anisotropic etch, such as KOH. Preferably, concurrent with step S630, the one surface of the first substrate is photolithographically patterned and etched to form the first filter array 55 between ink manifold 45 and internal chamber 26. While this reduces processing steps, it is possible to pattern and etch the first filter array 55 in a separate preceding or subsequent step. To further reduce processing steps, ink fill hole 25 can be formed by allowing the etching of ink internal chamber 56 to continue until it forms a through hole on a second, opposite surface of the first substrate.

At step S640, heating element array 34 and addressing elements 30, 32 are formed on one surface of the second substrate, which can also be a silicon wafer. This second substrate will eventually form heater plate 28. At step S650, insulating layer 18, preferably a polyimide layer, is deposited over the one surface of the second substrate. At step S660, the insulating layer 18 is patterned and select portions are removed to expose heating elements 34. To minimize processing steps, this patterning and removal step preferably includes patterning openings in the insulating layer to form the second filter array 60 within the insulating layer 18. However, array 60 could be patterned and formed in a separate step.

Once the channel plate 31 and heater plate 28 have been formed from the first and second substrates, the two substrates are aligned, mated and bonded at step S670 so that the one surface of the first substrate (channel plate 31) is mated to the one surface of the second substrate (heater plate 28) with the insulating layer 18 sandwiched therebetween. At this time, each heating element 34 of heater plate 28 will be opposed to a corresponding ink channel 27 in the channel plate 31 to form an ink jet printhead assembly.

Figure 7:
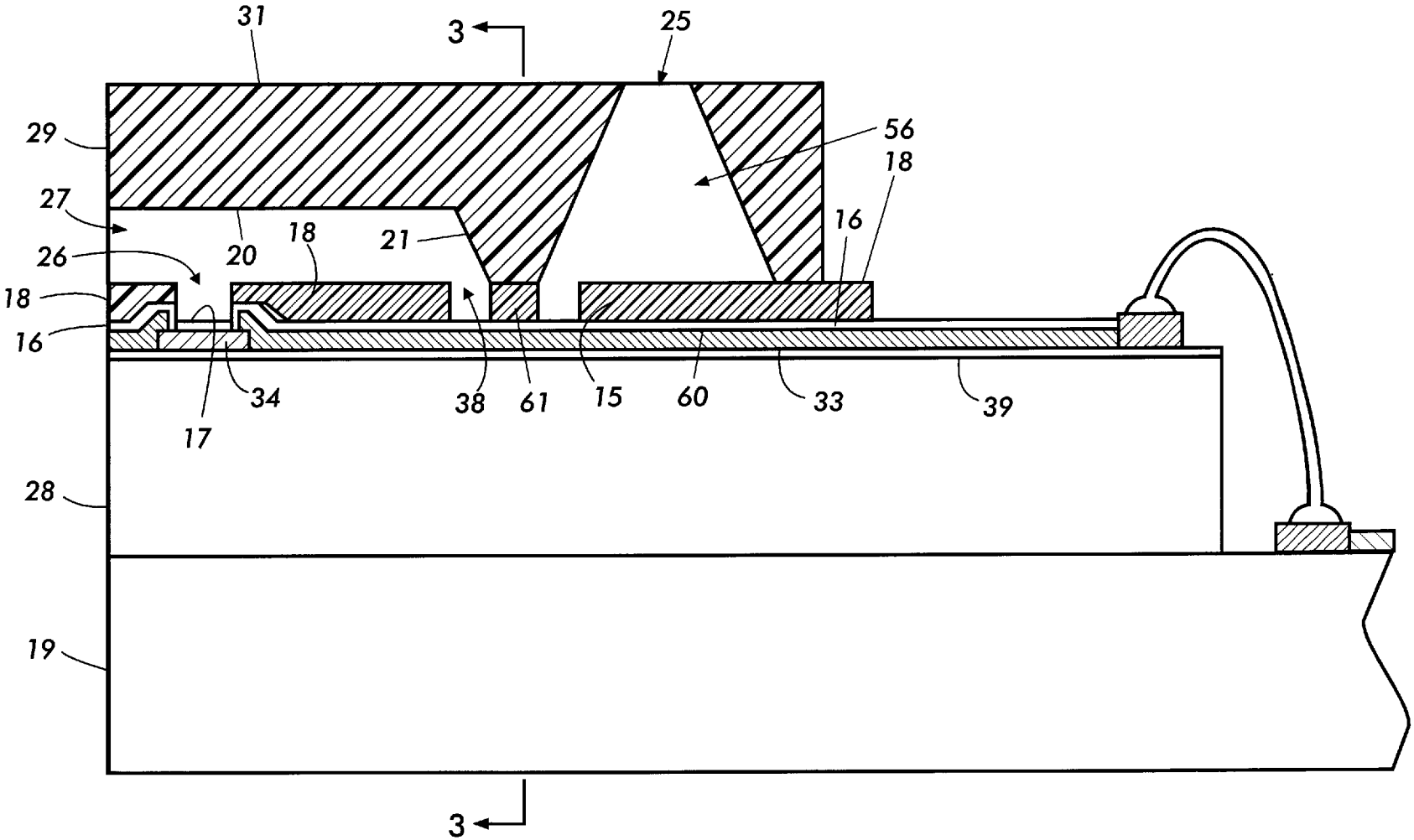
FIG. 7 is an enlarged cross-sectional view of FIG. 1 as viewed along line 7—7 showing an ink flow path between the internal chamber and ink channels through the internal filter structure according to an alternative embodiment of the invention.

FIG. 7 is an enlarged cross-sectional view of FIG. 1 as viewed along line 7—7 showing electrode passivation, an ink flow path between the manifold and ink channels, and internal filter structure according to an alternate embodiment of the invention in which the internal chamber 56 and ink manifold 45 are replaced with an internal ink chamber 56 directly connected to the ink fill hole 25. In this embodiment, the etched openings 55 are formed between the internal ink chamber 56 and ink channels 27.

Figure 8:
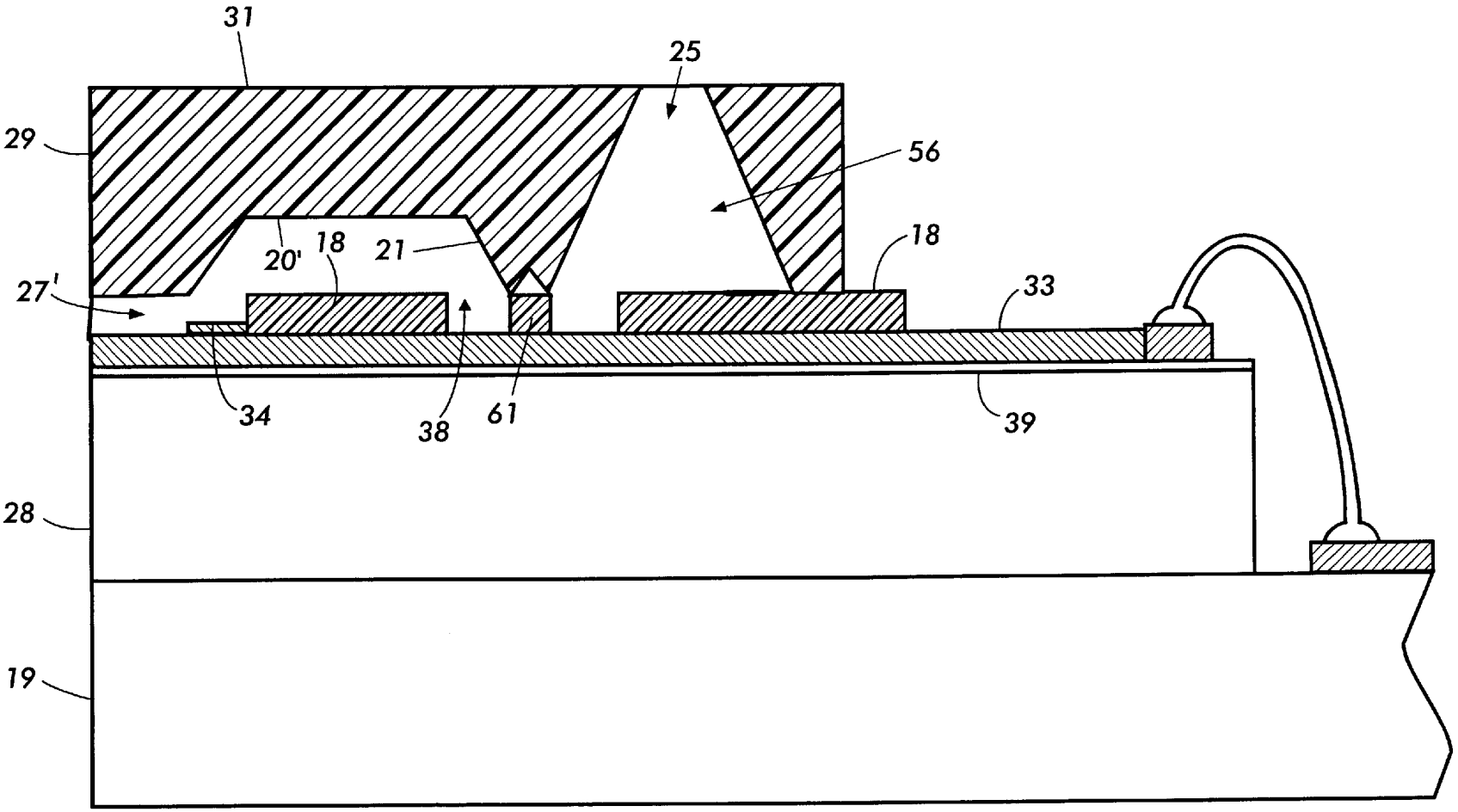
FIG. 8 is an enlarged cross-sectional view of FIG. 1 as viewed along line 8—8 showing an ink flow path between the internal chamber and ink channels through the internal filter structure according to yet another alternative embodiment of the invention.
Figure 9:
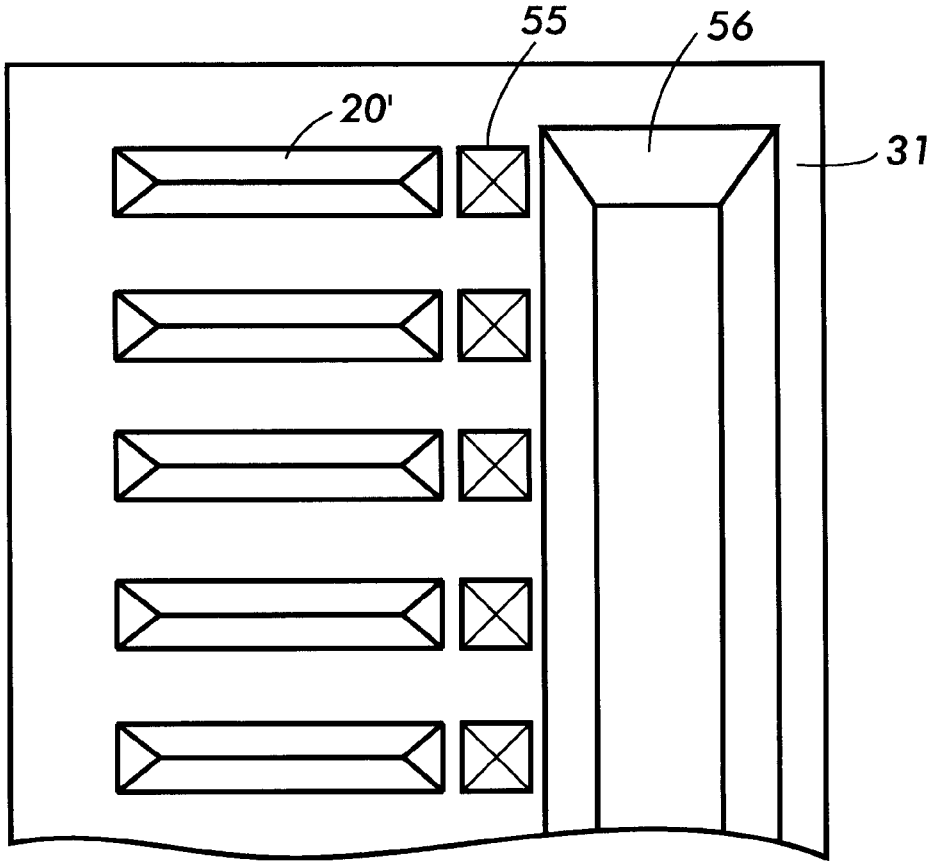
FIG. 9 is a partial view showing the etched structure on the channel plate of the FIG. 8 embodiment.

FIGS. 8–9 show a further alternative embodiment of the invention in which the first and second filter array portions remain as in the previous embodiment. However, in this embodiment, ink channels 27' are defined in the insulative layer 18 rather than etched in channel plate 31. Grooves 20' are provided to form a fluid bypass to allow the ink to travel from the first and second filter array portions to ink channels 27'. Thus, grooves 20' do not form ink nozzles extending from channel face 29 as in the other embodiments. Instead, ink channels 27' defined in the insulative layer form the ink nozzles.

Although the invention has been described in detail above with respect to several preferred embodiments, various modifications can be implemented without departing from the spirit and scope of the invention.

What is claimed is:

1. A method of forming a printhead comprising the steps of:

providing first and second silicon substrates;

anisotropically etching a set of parallel grooves and a first recess on one surface of the first substrate, the first recess forming an internal ink chamber;

anisotropically etching a set of parallel openings in the one surface of the first substrate of a predetermined pore size between the internal ink chamber and the set of parallel grooves, the set of parallel openings forming a first filter array portion;

forming an array of heating elements and addressing electrodes on one surface of the second silicon substrate;

depositing an insulating layer on the one surface of the second silicon substrate;

patterning the insulating layer to expose portions of the heating elements and to expose a set of openings forming a second filter array portion of a predetermined pore size; and aligning, mating and bonding the one surface of the first substrate to the one surface of the second substrate so that the second filter array portion is positioned in fluid communication with and between the internal ink chamber and the set of parallel grooves to form a printhead having a plurality of ink nozzle channels of a predetermined channel width that receive ink that has been filtered through at least one of the first and second filter array portions.

2. The method of claim 1, wherein the step of etching a set of parallel grooves forms the plurality of ink nozzle channels.

3. The method of claim 1, further comprising a step of forming the ink nozzle channels in the insulative layer, wherein the set of parallel grooves form fluid bypass chambers that communicate ink from the first and second filter array portions to the ink channel nozzles.

4. The method of claim 1, wherein the step of depositing deposits a layer of polyimide.

5. The method of claim 4, wherein the polyimide is deposited to a thickness of between 5 to 100 micrometers.

6. The method of claim 1, wherein the step of patterning involves a photoresist.

7. The method of claim 1, wherein the predetermined pore size of the set of parallel openings forming the first filter array portion is less than or equal to the width of the ink nozzle channels.

8. The method of claim 7, wherein the predetermined pore size of the set of openings forming the second filter array portion is substantially the same as the predetermined pore size of the set of parallel openings forming the first filter array portion.

9. The method of claim 1, wherein the step of anisotropically etching a set of parallel grooves and the step of anisotropically etching a set of parallel openings are performed concurrently.

10. The method of claim 1, wherein the step of anisotropically etching a set of parallel grooves further forms an ink manifold recess between the ink channels and the internal ink chamber recess.

* * * * *